US006732530B2

(12) United States Patent
Laurello et al.

(10) Patent No.: US 6,732,530 B2
(45) Date of Patent: May 11, 2004

(54) GAS TURBINE COMPRESSOR AND CLEARANCE CONTROLLING METHOD THEREFOR

(75) Inventors: Vincent Laurello, Miami, FL (US); Masanori Yuri, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 36 days.

(21) Appl. No.: 10/158,062

(22) Filed: May 31, 2002

(65) Prior Publication Data

US 2003/0223863 A1 Dec. 4, 2003

(51) Int. Cl.[7] ..... F02C 6/04; F02C 6/08

(52) U.S. Cl. ..... 60/782; 60/785; 415/115; 415/144

(58) Field of Search ..... 60/782, 785; 415/115, 415/144

(56) References Cited

U.S. PATENT DOCUMENTS 3,597,106 A * 8/1971 Anderson ..... 415/144
3,632,223 A * 1/1972 Hampton ..... 415/144
4,329,114 A * 5/1982 Johnston et al. ..... 415/145
6,325,595 B1 * 12/2001 Breeze-Stringfellow et al. . 415/144

FOREIGN PATENT DOCUMENTS

| | | |
|---|---|---|
| JP | 11-117767 | 4/1999 |
| JP | 11-125199 | 5/1999 |
| JP | 2941748 | 6/1999 |
| JP | 2000-27606 | 1/2000 |

* cited by examiner

*Primary Examiner*—Charles G. Freay
(74) *Attorney, Agent, or Firm*—Oblon, Spivak, McClelland, Maier & Neustadt, P.C.

(57) ABSTRACT

A plurality of moving blades are provided around rotor disks and rotate together with said rotor disks. Compressor rear case rings surround the periphery of these moving blades and form a compression flow path therein. A bleeding chamber is provided around the compressor rear case rings and introduces a portion of a main flow moving through the compression flow path as bleed air. Cooling flow path is formed between the compressor rear case rings and the bleeding chamber in which bleed air cf on its way to the bleeding chamber flows along the outer surface of the compressor rear case rings.

10 Claims, 3 Drawing Sheets

GAS TURBINE COMPRESSOR AND CLEARANCE CONTROLLING METHOD THEREFOR

BACKGROUND OF THE INVENTION

1. Field of the Invention

The present invention relates to a gas turbine compressor that can improve the efficiency of the compressor by maintaining optimal clearance between the moving blades and the rear case rings of the compressor during operation. The present invention further relates to a clearance controlling method for a gas turbine compressor.

2. Description of Related Art

In a gas turbine plant, compressed air from a gas turbine compressor is guided into a combustor, and the high-temperature gas generated when the compressed air is combusted together with a fuel is guided into the gas turbine to drive the gas turbine. A typical design is one in which a portion of the compressed air is bled and directed to the stationary and moving blades of the gas turbine side and is used to cool these blades.

FIG. 3 is a cross-sectional view showing the typical structure of the connecting member between the gas turbine compressor and the gas turbine in a conventional gas turbine plant as described above. As shown in FIG. 3, gas turbine compressor 1 is provided with a plurality of stationary blades 3 which are fixed in place inside case rings 2*a* in case 2, and a plurality of moving blades 5 which are attached to the periphery of each disk 4 which are coaxially fixed on the rotor side (rotor not shown). These stationary blades 3 and moving blades 5 are disposed so as to alternate with one another along the shaft orientation of the rotor and are designed to compress and send compressed air in the direction indicated by arrow f1 through rotation of the rotor.

The compressed air sent from gas turbine compressor 1 is directed to combustor 6 in which the compressed air is mixed with fuel and combusted to form a combustion gas. As it expands, the combustion gas hg passes through stationary blades 8 in gas turbine 7 and rotates moving blades 9, thereby rotationally driving the rotor (not shown) in gas turbine 7. At the same time, a portion (4~10% of the main flow, for example) of the compressed air which is flowing inside gas turbine compressor 1 becomes bleed air f2, and is taken up inside bleeding chamber 2*b* which is formed inside case 2. After being expelled out from case 2 via a flange 2*c* which is provided so as to communicate with bleeding chamber 2*b*, bleed air f2 is guided to stationary blades 8 and moving blades 9 on the gas turbine 7 side and cools these blades.

Bleeding chamber 2*b* is a ring-shaped space formed between each case ring 2*a* and case main body 2*d* which covers over the periphery of these case rings 2*a*. In the axial direction of the rotor of gas turbine 1, bleeding chamber 2 is provided so as to be overlapped the area where the end surfaces of respective case rings 2*a* face one another. In other words, the space intervals between facing end surfaces of case rings 2*a* form bleeding holes 2*e* for bleeding air into bleeding chamber 2*b* from compressed air f1, which is the main flow. Bleed air f2 is guided into bleeding chamber 2*b* toward the radial direction of the rotor with passing through bleeding holes 2*e*. Bleed air f2 is then quickly expelled outside via flange 2*c* for cooling.

Clearance of specific dimensions is maintained between moving blades 5 and case rings 2*a* in order to avoid contact between them during operation in gas turbine compressor 1. The clearance varies during operation depending on difference in thermal expansion between case 2, and disks 4 and moving blades 5. If the difference in thermal expansion between these parts becomes too large, the efficiency of the compressor in gas turbine compressor 1 may remarkably deteriorate. In view of this problem, it is necessary to adopt optimal clearance dimensions in the design after taking this factor into consideration.

In fact, however, thermal deformation of case rings 2*a* is complicated, so that it is difficult to provide a design that fits these circumstances with excellent precision. Namely, in compressor rear case ring 2*a*1 among case rings 2*a*, which is positioned at a later stage (i.e., most downstream position) in the compressor and in particular, has a great influence on the efficiency of the compressor in gas turbine compressor 1, the temperature of the main flow (compressed air f1) flowing inside compressor rear case ring 2*a*1 remarkably increases, for example, from 370° C. to 460° C., due to an increase in enthalpy by the effect of compression.

As a result of such large temperature difference, the overall shape of compressor rear case ring 2*a* when undergoing thermal expansion will deform such that it becomes gradually wider toward the direction of flow of compressed air f1. Accordingly, the clearance formed between moving blades 5 and the inner surface of compressor rear case rings 2*a* becomes gradually wider toward downstream from upstream, and therefore, the clearance does not have uniform dimensions.

Accordingly, the clearance dimensions during operation are not uniform along the axial direction of compressor rear case rings 2*a*1. This makes it difficult to provide a design that ensures optimal clearance dimensions, therefore, it becomes difficult to improve the efficiency of the compressor in gas turbine compressor 1.

BRIEF SUMMARY OF THE INVENTION

The present invention was conceived in view of the above-described circumstances and has an object that is to provide a gas turbine compressor that can improve the efficiency of the compressor by maintaining optimal dimensions for the clearance formed between the ends of the moving blades and the inner surface of the rear case rings of the compressor during operation. The present invention has the other object that is to provide a clearance controlling method for a gas turbine compressor.

The present invention employs the following means to resolve the above-described problems.

A gas turbine compressor according to a first aspect of the present invention comprises a plurality of moving blades which are provided around rotor disks and rotate together with the rotor disks; compressor rear case rings surrounding the periphery of these moving blades and forming a compression flow path therein; and a bleeding chamber which is provided around the compressor rear case rings and introduces a portion of a main flow moving through the compression flow path as bleed air; and a cooling flow path which is formed between the compressor rear case rings and the bleeding chamber in which bleed air on its way to the bleeding chamber flows along the outer surface of the compressor rear case rings.

According to the above-described gas turbine compressor, the main flow moving inside the compressor rear case rings is dependent on a compressing effect such that the temperature increases as the main flow moves toward downstream. As a result, the compressor rear case rings are heated from the inside. However, the bleed air which flows through the cooling flow path cools the compressor rear case rings from their periphery, so that temperature gradient becomes small along the axial direction. As a result, when the compressor rear case rings undergo thermal expansion, the expansion in the direction of their diameters at each position along the axial direction is roughly equivalent, making it easy to predict the behavior of thermal deformation. Accordingly, a design for ensuring optimal clearance is easily provided. Thus, the dimensions of the clearance that is formed between the ends of the moving blades and the inner surface of the compressor rear case rings can be optimized, so that the efficiency of the compressor can be further improved.

Furthermore, in the above-described gas turbine compressor, the cooling flow path may comprise boundaries in the axial direction when viewed in a cross-section that includes the axis of the compressor rear case rings, in which the boundaries include at least a region extending from a position on the upstream edge of the outer surface of the compressor rear case rings to a position at a furthest downstream corresponding to the moving blades.

According to the above gas turbine compressor, in the regions along the axial direction of the compressor rear case rings, the boundaries required for controlling clearance in particular are securely cooled. The dimensions of the clearance formed between the ends of the moving blades and the inner surface of the compressor rear case rings during operation can be maintained at optimal values with certainty. Accordingly, the efficiency of the compressor can be improved.

In the above-described gas turbine compressor, a sleeve in the shape of a ring or an interrupted ring is disposed so as to cover the bleeding flow intake for bleeding a portion of the main flow moving in the compression flow path. This bleed air may be made to flow along the outer surface of the compressor rear case rings.

According to this gas turbine compressor, the compressor case rings can be cooled from their periphery with certainty.

Moreover, in this gas turbine compressor, the shape of the cooling flow path when viewed upstream of the main flow may be scallop-shaped.

According to this gas turbine compressor, the heating surface area of the cooling flow path is larger than that of when a simple curved surface shape is used, therefore, higher cooling effects can be obtained.

In this gas turbine compressor, the compressor rear case rings may be made of a material having low linear expansion.

According to this gas turbine compressor, the thermal expansion can be reduced even at the same metal temperature, so that the overall amount of thermal expansion of the compressor rear case rings can be reduced. As a result, the clearance that is formed between the ends of the moving blades and the inner surface of the compressor rear case rings can be held to a small value. Accordingly, the efficiency of the compressor can be further improved.

Furthermore, in this gas turbine, a heat shield coating may be applied to the inner surface of the compressor rear casing rings.

According to this gas turbine compressor, the amount of heat introduced from the main flow can be reduced as a result of the heat shield coating for the same boundary conditions (i.e., for the same main flow temperature conditions). As a result, the metal temperature of the compressor rear case rings can be reduced, and the amount of thermal expansion overall can be reduced. Accordingly, the clearance formed between the ends of the moving blades and the inner surface of the compressor rear case rings can be held to a small value. Accordingly, the efficiency of the compressor can be further improved.

A method for controlling clearance in a gas turbine compressor according to a second aspect of the present invention is a method for controlling a clearance formed between ends of moving blades and an inner surface of compressor rear case rings in a gas turbine compressor which comprises a plurality of moving blades which are provided around rotor disks and rotate together with the rotor disks; compressor rear case rings surrounding the periphery of these moving blades and forming a compression flow path therein; and a bleeding chamber which is provided around the compressor rear case rings and introduces a portion of a main flow moving through the compression flow path as bleed air; the method comprising the steps of flowing bleed air on its way to the bleeding chamber along an outer surface of the compressor rear case rings, and introducing the bleed air into the bleeding chamber.

According to the above-described clearance controlling method for a gas turbine compressor, the main flow moving in the compressor rear case rings is subjected to a compressing effect so that the temperature increases as the flow moves further downstream. As a result, the compressor rear case rings are heated from the inside. However, the bleed air that flows over the outer surface cools the compressor rear case rings from their periphery, so that the temperature gradient becomes small along the axial direction. As a result, when the compressor rear case rings undergo thermal expansion, the expansion in the direction of their diameters at each position along the axial direction is roughly equivalent, making it easy to predict the behavior of thermal deformation. Accordingly, a design for ensuring optimal clearance is easily provided. Thus, the dimensions of the clearance that is formed between the ends of the moving blades and the inner surface of the compressor rear case rings can be optimized, so that the efficiency of the compressor can be further improved.

Furthermore, in the above-described clearance controlling method for a gas turbine compressor, flow boundaries of the bleed air to the outer surface when viewed in a cross-section that includes the axis of the compressor rear case rings, in which the boundaries at least the region extending from a position on the upstream edge of the outer surface to a furthest downstream position corresponding to the moving blades.

According to this clearance controlling method for a gas turbine compressor, the boundaries required for controlling clearance in particular are securely cooled along the axial direction of the compressor rear case rings. The dimensions of the clearance formed between the ends of the moving blades and the inner surface of the compressor rear case rings during operation can be optimized confidently. Accordingly, the efficiency of the compressor can be improved.

DETAILED DESCRIPTION OF THE INVENTION

An embodiment of a gas turbine compressor of the present invention and clearance controlling method therefor will now be explained with reference to the figures. The present invention is of course not limited to the embodiment.

Figure 3:
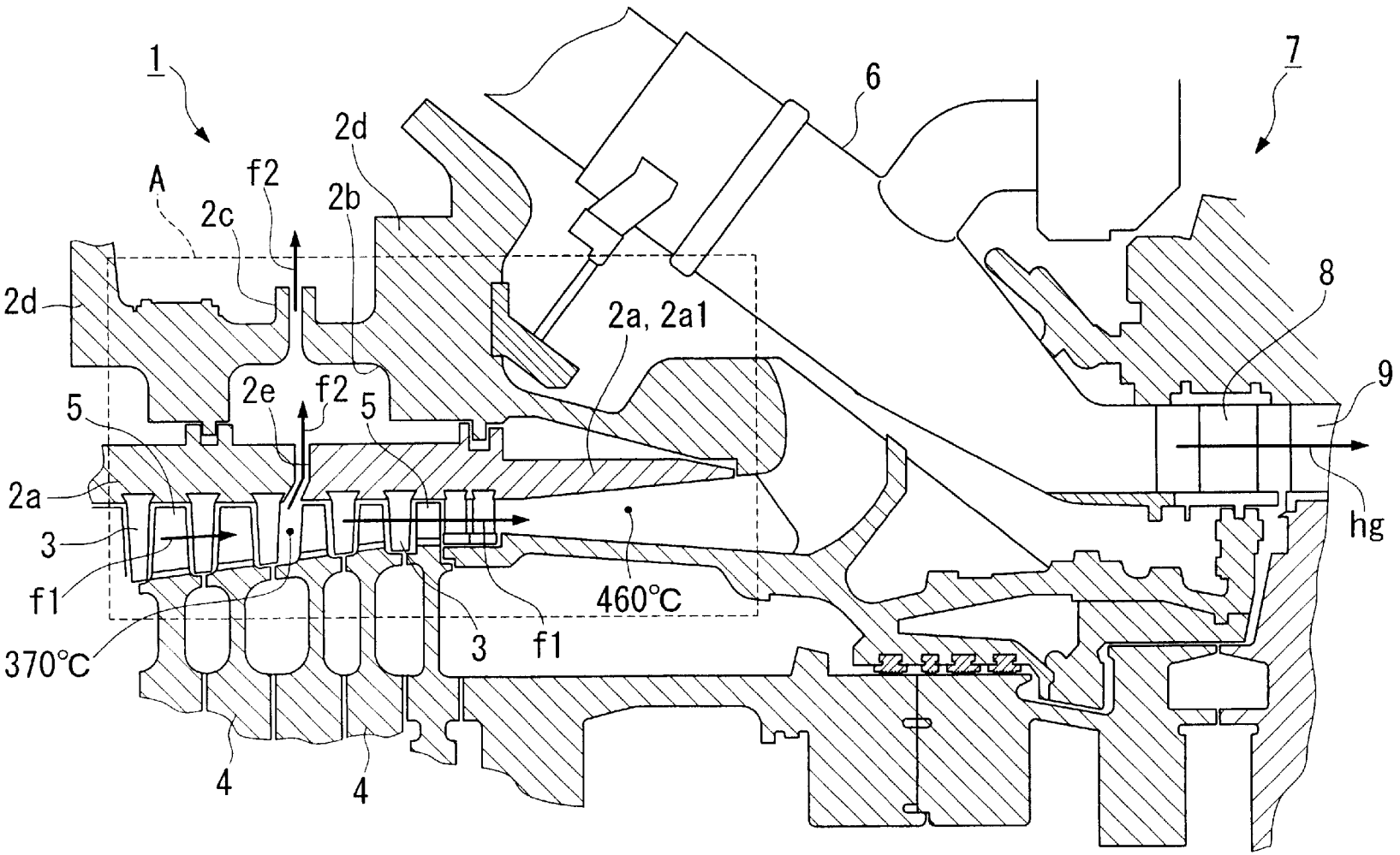
FIG. 3 is a view showing the essential parts of a conventional gas turbine compressor, and is a partial cross-sectional view when seen in a cross-section that includes the axis of the rotor.

The present embodiment is characterized by the portion corresponding to part A in FIG. 3 which has been provided in a conventional gas turbine compressor explained under the preceding Related Art section. This characteristic portion will be the main focus of the explanation, with an explanation of those parts that are identical to the conventional art omitted here.

Figure 1:
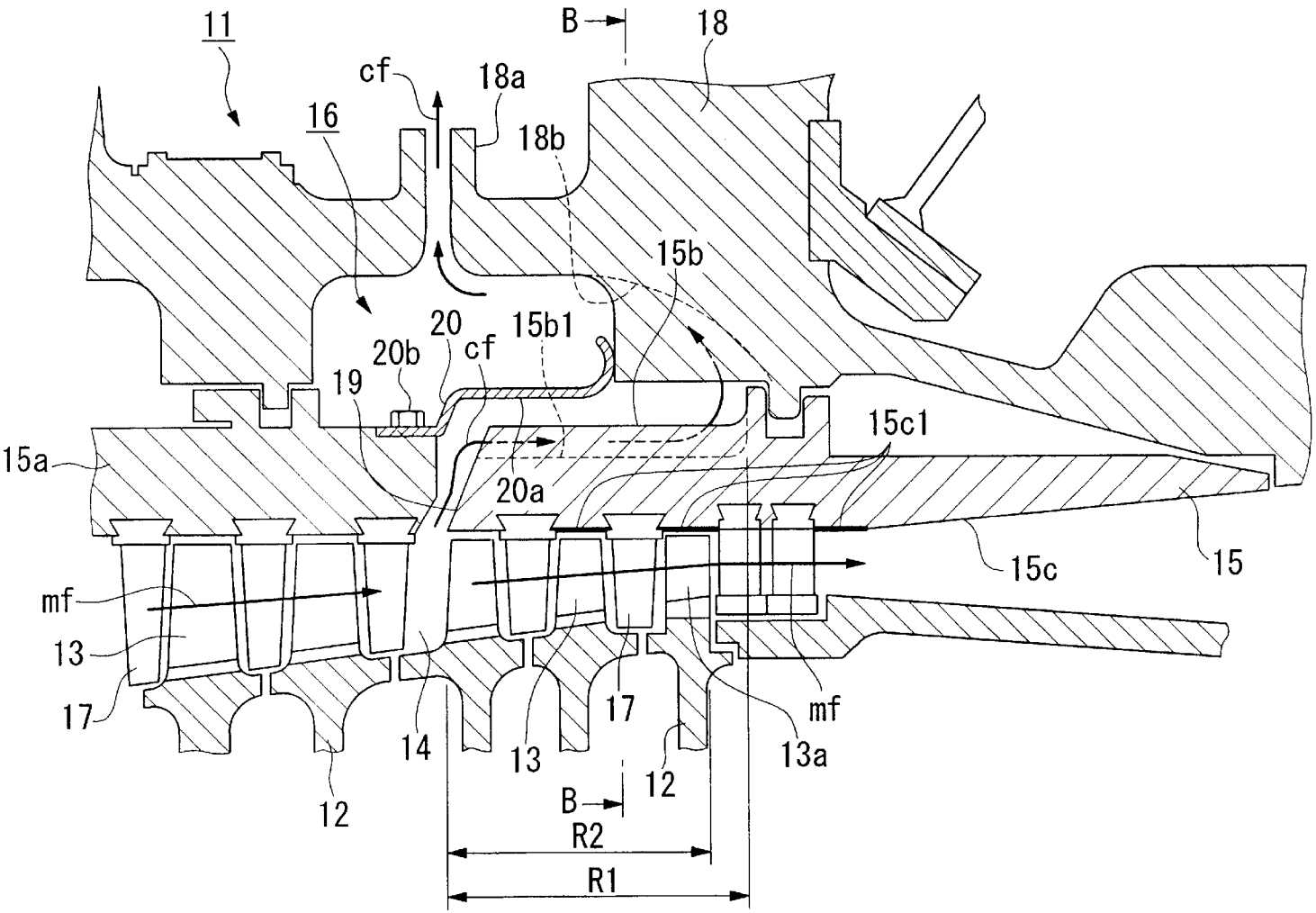
FIG. 1 shows an embodiment of a gas turbine compressor according to the present invention, and is an enlarged cross-sectional view of the portion corresponding to part A in FIG. 3.
Figure 2:
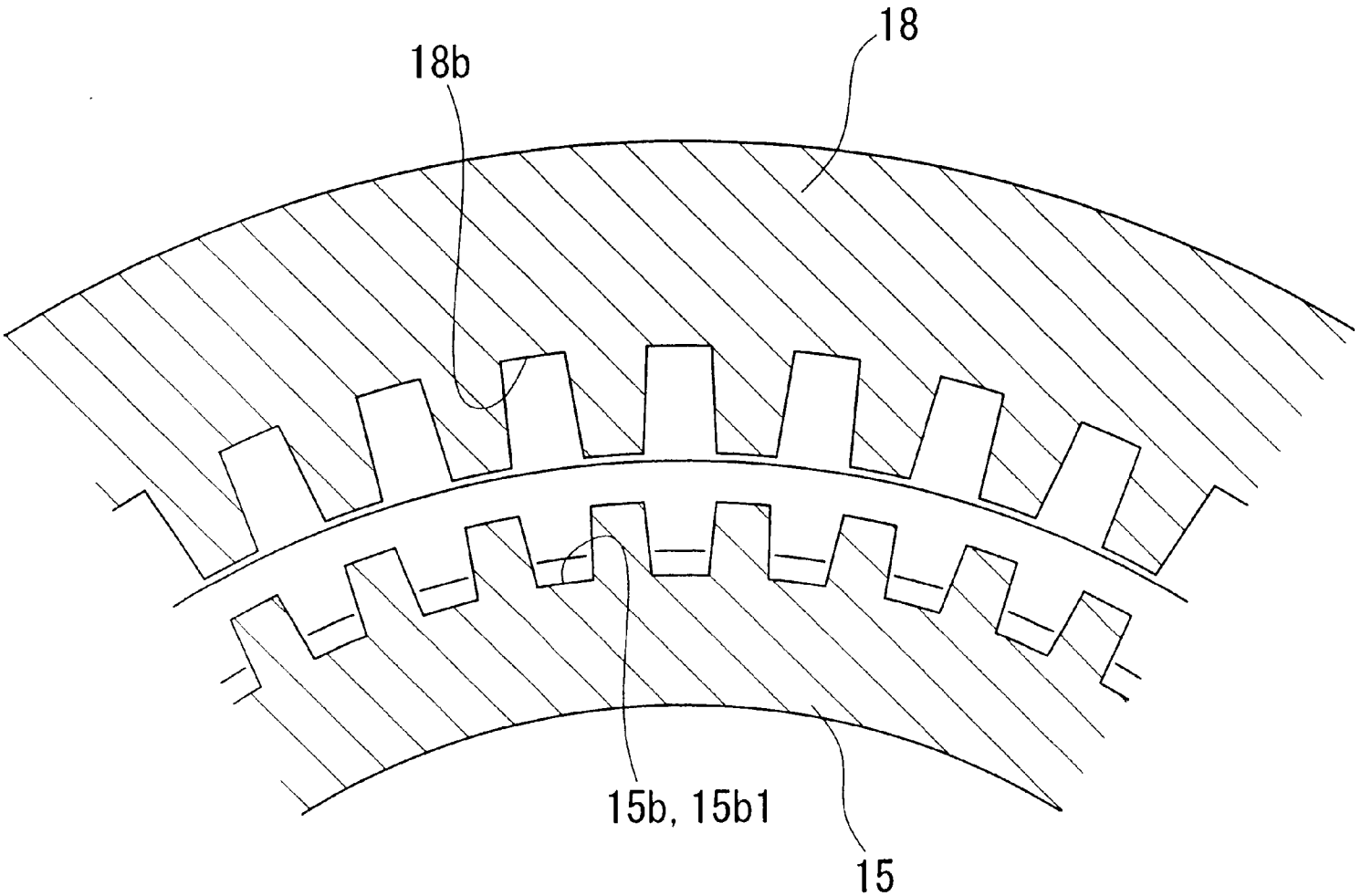
FIG. 2 is a view showing the essential parts of this same gas turbine compressor, and is a cross-sectional view along the line B—B in FIG. 1.

FIG. 1 shows the gas turbine compressor according to the present embodiment, and is an enlarged cross-sectional view of the portion corresponding to part A in FIG. 3. FIG. 2 shows the essential parts of this same gas turbine compressor and is a cross-sectional view along the line B—B in FIG. 1.

As shown in FIG. 1, gas turbine 11 of the present embodiment is provided with a plurality of rotor disks 12 that are fixed in place to a rotor, not shown, on the same shaft and so as to overlap with one another; a plurality of moving blades 13 that are provided to the respective peripheries of each rotor disk 12 and rotate together with these rotor disks; compressor rear case rings 15 that surround the periphery of moving blades 13 and form a compression flow path 14, and other case rings 15*a*; a bleeding chamber 16 that is provided to the periphery of compressor rear case rings 15 and other case rings 15*a* and introduces a portion of the main flow mf (compressed gas) moving in compression flow path 14 as bleed air cf; a plurality of stationary blades 17 that are fixed in place inside compressor rear case rings 15; and case main body 18 that holds compressor rear case rings 15 and other case rings 15*a* therein.

Note that in the following discussion, the flow directions of main flow mf on the upstream side (i.e., left side of the paper in FIG. 1) and on the downstream side (i.e., right side of the paper in FIG. 1) will be referred to as "upstream side" and "downstream side" respectively. Further, the direction of the axis (to the left and right in FIG. 1) of the rotor will be referred to as "axial direction" in the discussion.

The dimensions of the outer diameter of each rotor disk 12 gets gradually larger moving from upstream to downstream. In addition, the dimensions of the inner diameter of compressor rear case rings 15 and other case rings 15*a* are constant along the axial direction. As a result, the shape of compression flow path 14 that is formed between these outer and inner diameters becomes gradually narrower moving from upstream to downstream.

Each stationary blade 17 is fixed in place on the respective inner surfaces of compressor rear case rings 15 and other case rings 15*a*, and is aligned along the circumferential direction centered about the rotor shaft. Further, when viewed from the axial direction, stationary blades 17 are disposed alternating with moving blades 13.

Rotor disks 12 and moving blades 13 rotate with the turning of the rotor, so that the air inside compression flow path 14 is compressed and sent downstream, to generate an air flow (main flow mf).

Compressed air compressed and sent from gas turbine compressor 11 is guided to a combustion chamber not shown in the figures, mixed with fuel and combusted to form combustion gas. As it expands, this combustion gas turns the stationary blades and moving blades (not shown) on the gas turbine side, thereby rotationally driving the gas turbine's rotor.

Bleeding chamber 16 is a ring-shaped concavity that is formed inside case main body 18 and is designed to introduce a portion of the main flow mf (4~10% of the main flow for example) as bleed air cf. In other words, the ring-shaped space that is formed between the opposing end surfaces of compressor rear case rings 15 and other case rings 15*a* that are adjacent to and upstream from compressor rear case rings 15 form bleed air flow path 19. Bleed air cf is taken up into bleeding chamber 16 via this bleed air flow path 19.

The bleed air cf that is taken up into bleeding chamber 16 is expelled to the outside via a flange 18*a* that is provided to case main body 18 so as to communicate with bleeding chamber 16. Once expelled outside the case in this manner, bleed air cf is directed to the stationary blades and moving blades in the gas turbine and used to cool these blades.

It is a characteristic feature of gas turbine compressor 11 of the present embodiment that cooling flow path 15*b*1 is provided between compressor rear case rings 15 and bleeding chamber 16 in which bleed air cf on its way to bleeding chamber 16 flows along the outer surface 15*b* of the compressor rear case rings 15.

Cooling flow path 15*b*1 is formed between outer surface 15*b* and inner surface 20*a* of flow guide member 20 which is fixed in place to other case rings 15*a*. When viewed in a cross-section that includes the shaft of compressor rear case rings 15, the limits R1 in the axial direction of this cooling flow path 15*b* include limits R2 which extend from a position on the upstream edge of outer surface 15*b* to a position corresponding to moving blade 13*a* which is positioned furthest downstream. As a result, bleed air cf which has been taken up via bleed air flow path 19 can be guided from the upstream to far along the downstream side of outer surface 15*b*.

As shown in FIG. 2, the shape of cooling flow path 15*b*1 when viewed from the upstream side of main flow mf is such that outer surface 15*b* of rear case rings 15 which is covered by flow guide 20 is scallop-shaped in a circumferential direction centered about the shaft. By employing is type of shape, the heating surface area of cooling flow path 15*b*1 is larger than when a simple curved shape is used, therefore higher cooling effects can be obtained.

Similarly, the portion of inner surface 18*b* of case main body 18 which faces cooling flow path 15*b*1 is scallop-shaped. As a result, during bleed air cf is flowing through cooling flow path 15*b*1 and is turning back toward bleeding chamber 16, bleed air can be adjusted to a smooth flow.

Compressor rear case rings 15 are ring-shaped members made of a material having low linear expansion such as SUS410 for example, and are attached inside case main body 18 in such a way as to permit expansion of their diameter in the radial direction. Further, a heat insulating coating 15*c*1 may be applied to the inner surface 15*c* of compressor rear case rings 15. By selecting this type of material and applying this coating, it is possible to minimize the amount of thermal deformation in compressor rear case rings 15.

In other words, by employing a material having low linear expansion, it is possible to reduce thermal expansion even at the same metal temperature. Thus, the amount of thermal expansion in compressor rear case rings 15 overall can be reduced. The amount of heat introduced from the main flow mf can be reduced as a result of this thermal insulating coating 15*c*1 for the same boundary conditions (i.e., for the same main flow temperature conditions). As a result, the metal temperature of compressor rear case rings 15 can be reduced, so that the amount of thermal expansion overall can be reduced. Accordingly, the clearance formed between the ends of moving blades 13 and inner surface 15*c* of compressor rear case rings 15 can be held to a small value.

Coating of the entire face of inner surface 15*c* might be considered when deciding where to apply thermal insulating coating 15*c*1. However, from the perspective of maintaining the smoothness of this inner surface 15*c*, it is desirable to limit coating to only those areas where the main flow temperature becomes particularly high, such as shown in FIG. 1.

Guide member 20 may be formed from a thin sheet such as SUS, and may be fixed in place to other case rings 15*a* with a bolt 20*b*. Guide member 20 may be a ring-shaped sleeve or an interrupted ring-shaped sleeve formed so as to cover the region from R1 to R2. This covered surface forms a smooth cylindrical surface. As a result of guide member 20, bleed air cf is not directly directed at bleeding chamber 16, but rather is made to pass through cooling flow path 15*b*1. Note that guide member 20 may be formed as a separate part from other case rings 15*a*, or may be formed in a unitary manner with other case rings 15*a*. Further, it is acceptable to incline the flow intake for bleeding chamber 16, so that a portion of the flow comes in contact with the covering surface of guide member 20. In a gas turbine compressor 11 having the design as described above, bleed air cf on its way to bleeding chamber 16 flows along the outer surface 15*b* of compressor rear case rings 15 to enter into bleeding chamber 16. As a result, the dimensions of the clearance between the ends of the moving blades 13 and the inner surface 15*c* can be controlled to a minimum value during operation. In other words, main flow mf which is moving through compressor rear case rings 15 is subjected to a compressing action, so that its temperature increases gradually further downstream. As a result, compressor rear case rings 15 are heated from the inside. However, the bleed air cf that flows through cooling flow path 15*b*1 cools compressor rear case rings 15 from their periphery, so that the temperature gradient along the axial direction is reduced.

The effects obtained from gas turbine compressor 11 and a clearance controlling method therefore according to these embodiments as explained above will now be summarized below.

Namely, in the present embodiment, a design/method were employed in which a cooling flow path 15*b*1 is formed between compressor rear case rings 15 and bleeding chamber 16, wherein bleed air cf on its way to bleeding chamber 16 flows along the outer surface 15*b* of compressor rear case rings 15. As a result, bleed air cf flowing through cooling flow path 15*b*1 cools compressor rear case rings 15 from their periphery, so that the temperature gradient along the axial direction is made smaller. As a result, when the compressor rear case rings undergo thermal expansion, their expansion in the direction of their diameter at each position along the axial direction is roughly equivalent, making it easy to predict the behavior of thermal deformation. Accordingly, it becomes an easy matter to provide a design that maintains optimal clearance. Thus, the dimensions of the clearance that is formed between the ends of moving blades 13 and inner surface 15*c* of the compressor rear case rings 15 can be optimized, so that the efficiency of the compressor can be further improved.

In these embodiments, a design/method is employed in which the limits formed along the axial direction of compressor rear case rings 15 for cooling flow path 15*b*1 include a position on the upstream edge of outer surface 15*b* to a position corresponding to moving blade 13*a* which is positioned furthest downstream. As a result, the dimensions of the clearance that is formed between the ends of moving blades 13 and inner surface 15*c* of compressor rear case rings 15 can be optimized with even greater confidence. Accordingly, the efficiency of the compressor can be further improved.

Moreover, in these embodiments, a scallop-shaped design was employed for the shape of cooling flow path 15*b*1. As a result, the heating surface area of cooling flow path 15*b*1 is larger than when a simple curved shape is used, therefore higher cooling effects can be obtained.

These embodiments also employed a material having low linear expansion for compressor rear case rings 15. With this design, the clearance that is formed between the ends of moving blades 13 and inner surface 15*c* of compressor rear case rings 15 can be held to a small value. Accordingly, the efficiency of the compressor can be further improved.

In these embodiments, a heat insulating coating 15*c*1 was applied to inner surface 15*c* of compressor rear casing rings 15. As a result, the amount of heat introduced from the main flow mf can be reduced by this thermal insulating coating 15*c*1. Accordingly, the clearance formed between the ends of moving blades 13 and inner surface 15*c* of compressor rear case rings 15 can be held to a small value. Thus, the efficiency of the compressor can be further improved.

What is claimed is:

1. A gas turbine compressor comprising:

a plurality of moving blades which are provided around rotor disks and rotate together with said rotor disks;

compressor rear case rings surrounding the periphery of these moving blades and forming a compression flow path therein;

a bleeding chamber which is provided around the compressor rear case rings and introduces a portion of a main flow moving through the compression flow path as bleed air; and a cooling flow path which is formed between the compressor rear case rings and the bleeding chamber in which all bleed air on its way from a bleed air intake hole to the bleeding chamber flows through the cooling flow path and along an outer surface of the compressor rear case rings.

2. A gas turbine compressor according to claim 1, wherein boundaries of the cooling flow path in an axial direction when viewed in a cross-section which includes an axis of the compressor rear case rings include at least a region extending from a position on an upstream edge of the outer surface to a position at furthest downstream corresponding to a moving blade.

3. A gas turbine compressor according to claim 1, wherein the compressor rear case rings employ a material having a low linear expansion.

4. A gas turbine compressor, comprising:

a plurality of moving blades which are provided around rotor disks and rotate together with said rotor disks;

compressor rear case rings surrounding the periphery of these moving blades and forming a compression flow path therein;

a bleeding chamber which is provided around the compressor rear case rings and introduces a portion of a main flow moving through the compression flow path as bleed air;

a cooling flow path which is formed between the compressor rear case rings and the bleeding chamber in which bleed air on its way to the bleeding chamber flows along an outer surface of the compressor rear case rings; and a sleeve in a shape of a ring or an interrupted ring is disposed so as to cover a bleed air intake hole for bleeding a portion of the main flow moving through the compression flow path; and the bleed air flows along the outer surface of the compressor rear case rings.

5. A gas turbine compressor comprising:

a plurality of moving blades which are provided around rotor disks and rotate together with said rotor disks;

compressor rear case rings surrounding the periphery of these moving blades and forming a compression flow path therein;

a bleeding chamber which is provided around the compressor rear case rings and introduces a portion of a main flow moving through the compression flow path as bleed air; and a cooling flow path which is formed between the compressor rear case rings and the bleeding chamber in which bleed air on its way to the bleeding chamber flows along an outer surface of the compressor rear case rings, wherein a shape of the cooling flow path when viewed upstream from the main flow is scallop-shaped.

6. A gas turbine compressor comprising:

a plurality of moving blades which are provided around rotor disks and rotate together with said rotor disks;

compressor rear case rings surrounding the periphery of these moving blades and forming a compression flow path therein;

a bleeding chamber which is provided around the compressor rear case rings and introduces a portion of a main flow moving through the compression flow path as bleed air; and a cooling flow path which is formed between the compressor rear case rings and the bleeding chamber in which bleed air on its way to the bleeding chamber flows along an outer surface of the compressor rear case rings, wherein a heat shield coating is applied to an inner surface of the compressor rear case rings.

7. A method for controlling a clearance formed between ends of moving blades and an inner surface of compressor rear case rings in a gas turbine compressor which comprises a plurality of moving blades which are provided around rotor disks and rotate together with said rotor disks; compressor rear case rings surrounding these moving blades and forming a compression flow path therein; and a bleeding chamber which is provided around the compressor rear case rings and introduces a portion of a main flow moving through the compression flow path as bleed air;

the method comprising the steps of flowing all bleed air on its way from a bleed air intake hole to the bleeding chamber through the cooling flow path and along an outer surface of the compressor rear case rings, and introducing the bleed air into the bleeding chamber.

8. A method for controlling clearance according to claim 7, wherein flow boundaries of the bleed air to the outer surface when viewed in a cross-section that includes an axis of the compressor rear case rings, in which the boundaries at least an area extending from an upstream edge of the outer surface to a position at furthest downstream corresponding to the moving blade.

9. A method for controlling a clearance formed between ends of moving blades and an inner surface of compressor rear case rings in a gas turbine compressor which comprises a plurality of moving blades which are provided around rotor disks and rotate together with said rotor disks; compressor rear case rings surrounding these moving blades and forming a compression flow path therein; and a bleeding chamber which is provided around the compressor rear case rings and introduces a portion of a main flow moving through the compression flow path as bleed air;

the method comprising the steps of providing a sleeve in a shape of a ring or an interrupted ring so as to cover a bleed air intake hole for bleeding a portion of the main flow moving through the compression flow path, flowing bleed air on its way to the bleeding chamber along an outer surface of the compressor rear case rings, and introducing the bleed air into the bleeding chamber.

10. A method for controlling a clearance formed between ends of moving blades and an inner surface of compressor rear case rings in a gas turbine compressor which comprises a plurality of moving blades which are provided around rotor disks and rotate together with said rotor disks; compressor rear case rings surrounding these moving blades and forming a compression flow path therein; and a bleeding chamber which is provided around the compressor rear case rings and introduces a portion of a main flow moving through the compression flow path as bleed air;

the method comprising the steps of applying a heat shield coating to an inner surface of the compressor rear case rings, flowing bleed air on its way to the bleeding chamber along an outer surface of the compressor rear case rings, and introducing the bleed air into the bleeding chamber.

* * * * *